US005772009A

United States Patent [19]

Rogers et al.

[11] Patent Number: 5,772,009

[45] Date of Patent: Jun. 30, 1998

[54] OPERATING MECHANISM FOR SWITCHES AND FAULT INTERRUPTERS

[75] Inventors: Edward J. Rogers; Joel A. Ramos, both of Chicago, Ill.

[73] Assignee: S&C Electric Company, Chicago, Ill.

[21] Appl. No.: 713,938

[22] Filed: Sep. 13, 1996

[51] Int. Cl.[6] ..... H01H 5/00

[52] U.S. Cl. ..... 200/400

[58] Field of Search ..... 218/153, 154, 218/7, 14, 78, 84, 120, 140; 200/400; 74/2, 100.1

[56] References Cited

U.S. PATENT DOCUMENTS

| | | | |
|---|---|---|---|
| 3,563,102 | 2/1971 | Bernatt et al. | 74/100.1 |
| 3,845,433 | 10/1974 | Kraulits et al. | 335/254 |
| 4,253,003 | 2/1981 | Evans | 200/400 |
| 4,293,834 | 10/1981 | Date et al. | 335/76 |
| 4,484,046 | 11/1984 | Neuhouser | 200/144 B |
| 4,539,538 | 9/1985 | Flick et al. | 335/16 |
| 4,578,551 | 3/1986 | Lin | 200/400 |
| 4,683,357 | 7/1987 | Opfer | 200/560 |
| 5,140,117 | 8/1992 | Vianson | 200/400 |
| 5,224,590 | 7/1993 | Milianowicz | 200/400 |
| 5,276,288 | 1/1994 | Erickson et al. | 200/400 |
| 5,504,293 | 4/1996 | Rogers et al. | 218/154 |
| 5,521,567 | 5/1996 | Devonald, III et al. | 335/132 |

*Primary Examiner*—Matthew V. Nguyen
*Attorney, Agent, or Firm*—James V. Lapacek

[57] ABSTRACT

An operating mechanism that provides multiple operational output states at a first output and additional operational output states at a second output that are synchronized with the first output to provide a predetermined sequence of control. The operating mechanism includes an output lever that is pivoted by the stored energy in a spring and latch levers that are selectively operated to release the output lever. When the output lever is moved between operational positions, the output lever is stopped in its pivoting movement via the latch levers.

13 Claims, 8 Drawing Sheets

OPERATING MECHANISM FOR SWITCHES AND FAULT INTERRUPTERS

BACKGROUND OF THE INVENTION

1. Field of the Invention

The present invention relates generally to a compact operating mechanism for a switchgear assembly and more particularly to a quick-make quick-break operating mechanism for electrical circuit interrupters, i.e. load-interrupter switches and fault interrupters, the operating mechanism providing three operational output states at a first output point and a second output sequenced with the first output that has two operational states.

2. Description of Related Art

Various operating mechanisms for electrical switches and circuit interrupters provide multiple operational states at an output corresponding to the desired operational states of the switch controlled by the mechanism. For example, U.S. Pat. No. 5,504,293 discloses a useful compact operating mechanism that utilizes four latch members that cooperate with an output lever to define three operating positions, the latch members functioning to stop and hold the output lever to define the operating positions. While this arrangement is compact, it would be desirable to reduce the complexity and utilize a linear spring member that can be placed outside the remainder of the operating mechanism. Considering other operating mechanisms, U.S. Pat. No. 3,563,102 discloses a quick-make quick-break mechanism for operating a switch between open and closed positions. A manual switch operator for operating a vacuum interrupter and a series connected disconnect between two operating positions is disclosed in U.S. Pat. No. 4,484,046. The arrangement on closing, closes the disconnect switch before the vacuum interrupter, and on opening, opens the vacuum interrupter before the disconnect. An additional solenoid switch operator is coupled to the interconnection provisions between the manual switch operator and the vacuum interrupter for opening the vacuum interrupter through solenoid action. While this arrangement may be useful, it does not provide a compact operating mechanism for sequencing the operation of an interrupter with a disconnect in three operating positions. Further, the arrangement includes expansive linkages and toggle joints which are not desirable, not only from a mechanical design standpoint but also from the perspective of minimizing the size of switchgear modules that house the operator and the electrical components. Other operating mechanisms are shown in the following U.S. Pat. Nos.: 3,845,433; 4,293,834; 5,140,117; and 5,224,590.

SUMMARY OF THE INVENTION

Accordingly, it is a principal object of the present invention to provide a compact and efficient operating mechanism for the operational control and sequencing of two different outputs.

It is another object of the present invention to provide an operating mechanism including multiple operational output states and a pivotal output member that is stopped in its movement by latch levers that are also utilized to release the output member.

These and other objects of the present invention are achieved by an operating mechanism that provides multiple operational output states at a first output and additional operational output states at a second output that are synchronized with the first output to provide a predetermined sequence of control. The operating mechanism includes an output lever that is pivoted by the stored energy in a spring and latch levers that are selectively operated to release the output lever. When the output lever is moved between operational positions, the output lever is stopped in its pivoting movement via the latch levers.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
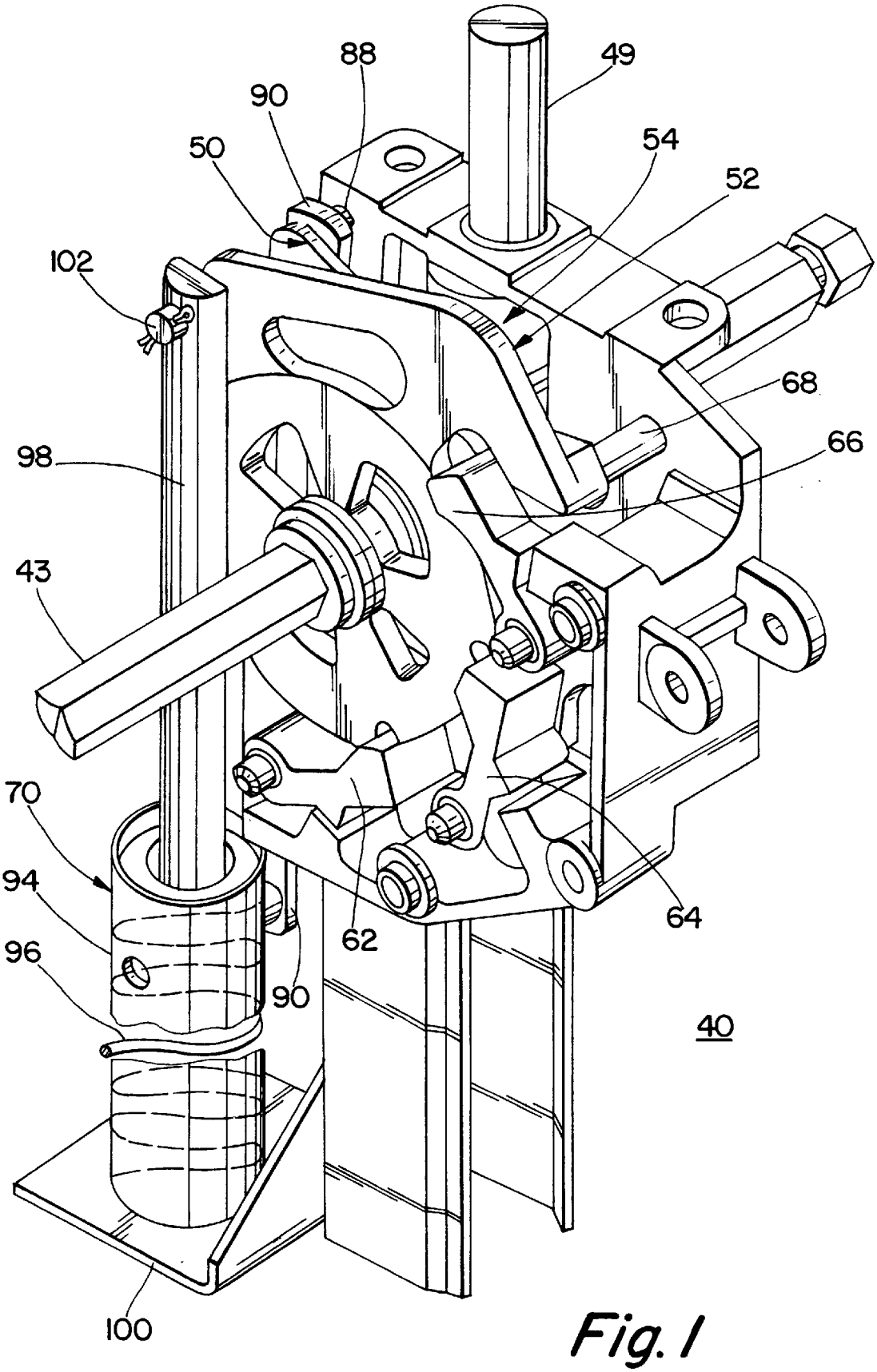
FIG. 1 is a perspective view of an operating mechanism in accordance with the principles of the present invention.

Referring now to FIGS. 1–5, an operating mechanism 40 in accordance with a specific embodiment of the present invention is of the general type shown in U.S. Pat. No. 5,504,293 and is suitable for use to operate the loadbreak switches and disconnects of U.S. Pat. No. 5,521,567 and copending U.S. application serial Nos. 08/653,176 filed in the names of B. B. McGlone et al. on May 24, 1996 and Ser. No. 08/705,460 filed in the names of T. G. French et al. on Aug. 29, 1996. In a specific illustrative embodiment, the operating mechanism 40 is operable between ground, open and closed operational position, the operating mechanism 40 being shown in the ground position in FIGS. 1–3.

The operating mechanism 40 includes a drive lever 50 and an output lever 52 which may also be referred to as a driven lever. The drive lever 50 is pivoted (rotated) via a gear drive arrangement 54 (best seen in FIG. 3) including a first bevel gear 56 that is rotatable by a charging/drive input 49 and a second bevel gear sector 58 fixed on the drive lever 50 and driven by the first bevel gear 56. The drive lever 50 also includes cam surfaces 60, 61 which are arranged to selectively contact and lift three latch levers 62, 64 and 66 during operation. The latch levers 62, 64 and 66 are pivotally mounted and circumferentially arranged around the mechanism 40 at the appropriate points in the pivotal movement of the drive lever 50 to achieve the desired operation of the mechanism 40, i.e. to release the output lever 52 to pivot (rotate) in response to the stored energy in a spring arrangement generally referred to at 70.

In accordance with important aspects of the present invention, the output lever 52 is stopped when moving between adjacent positions by cooperation between the output lever 52 and a respective one of the latch arms 62, 64, or 66, after the desired drive output rotation is obtained at an output shaft 43. The output shaft 43 is fixed to and rotates with the output lever 52. In this manner, the multiple operating positions are achieved. Further, in an illustrative arrangement, the output lever 52 includes an output pin at 68 for driving an output link 69 for actuating a single pole of a switch, while the output shaft 43 is connected to drive additional poles of a multi-pole switch (not shown).

Figure 3:
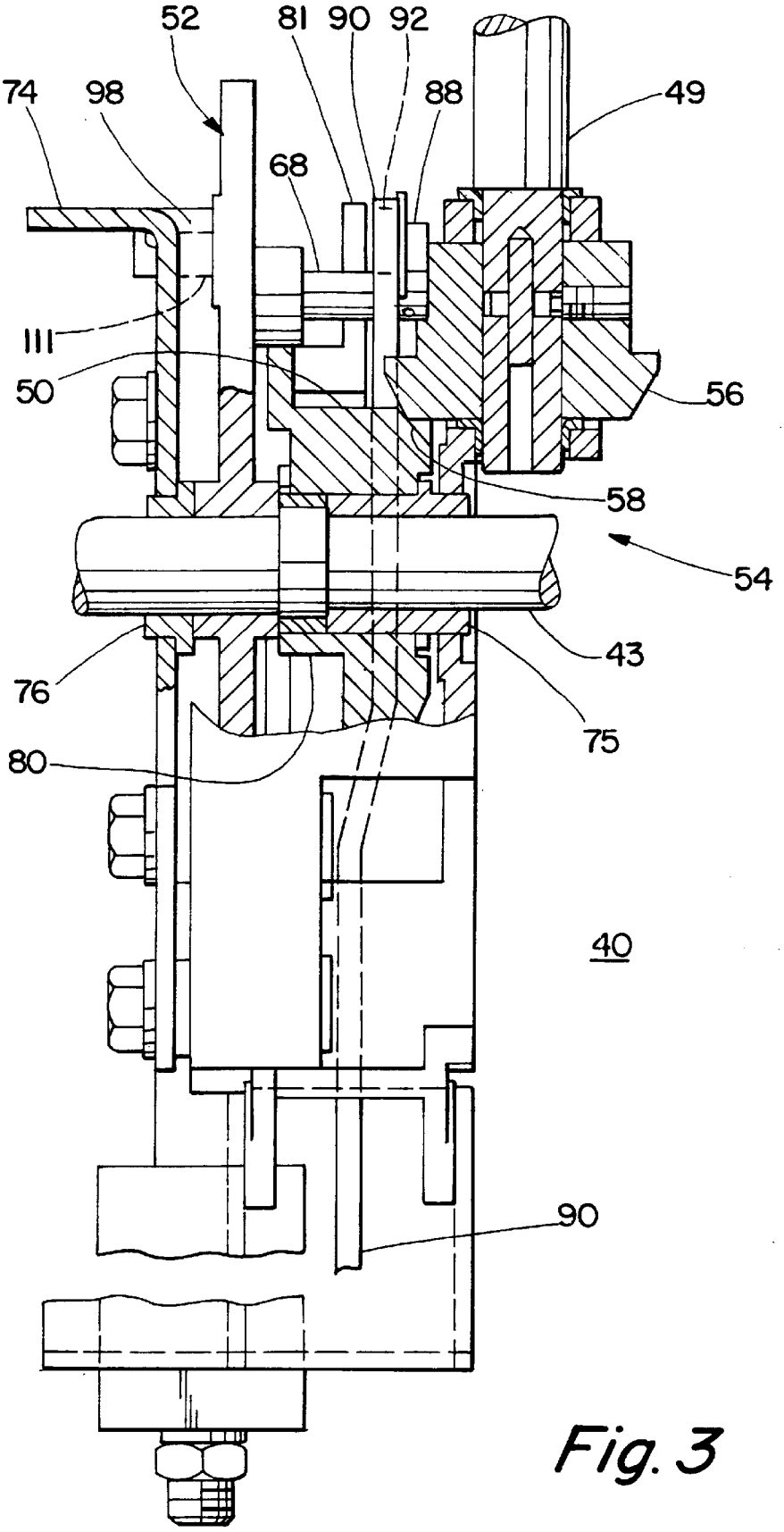
FIG. 3 is a right-side elevational view of FIG. 1, partly in section and with parts cut away for clarity.

The mechanism 40 includes a housing 72 and a cover portion 74. The output shaft 43 is pivotally mounted via a first bearing 75 on the housing 72 and a second bearing 76 on the cover portion 74 (removed for clarity in FIG. 1). The drive lever 50 is pivotally mounted with respect to the housing 72, e.g. as shown in FIG. 3, about the cylindrical outer surface 77 of the first bearing 75, the outer surface 77 functioning as a bearing surface.

Figure 4:
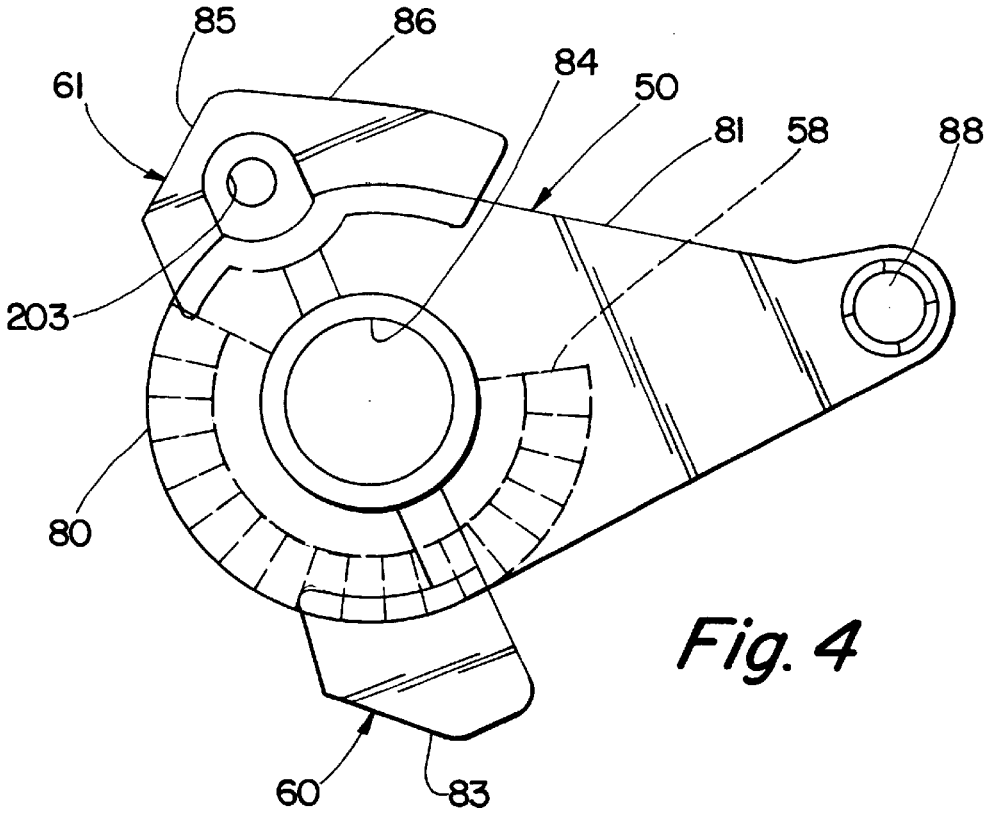
FIG. 4 is an elevational view of a drive lever of the operating mechanism of FIGS. 1–3.

Referring now additionally to FIG. 4, the drive lever 50 includes a central hub portion 80 with central aperture 84 and a radially extending arm 81. The two eccentric cam surfaces 60, 61 for operating the latch levers 62, 64 and 66 includes three latch kick-out portions 83, 85 and 86, the functioning of which will be explained in more detail hereinafter. The radially extending arm 81 includes a pin 88 (FIGS. 1, 3) which is arranged to drive a charging link 90 of the spring arrangement 70, e.g. via an aperture 92 in the charging link 90. The charging link 90 is arranged to drive a cylinder 94 of the spring arrangement 70. The spring arrangement 70 includes a spring 96 (referred to diagrammatically in FIG. 1) which is arranged between the cylinder 94 and an output rod 98. The cylinder 94 is slidably supported within a guide bracket 100 extending from the housing 72. The end of the output rod 98 is pivotally affixed to the output lever 52. When the charging link 90 is driven downwardly in FIGS. 1–3 via rotation of the drive lever 50 so as to drive the cylinder 94 downward, the spring 96 of the spring arrangement 70 is charged.

Figure 5:
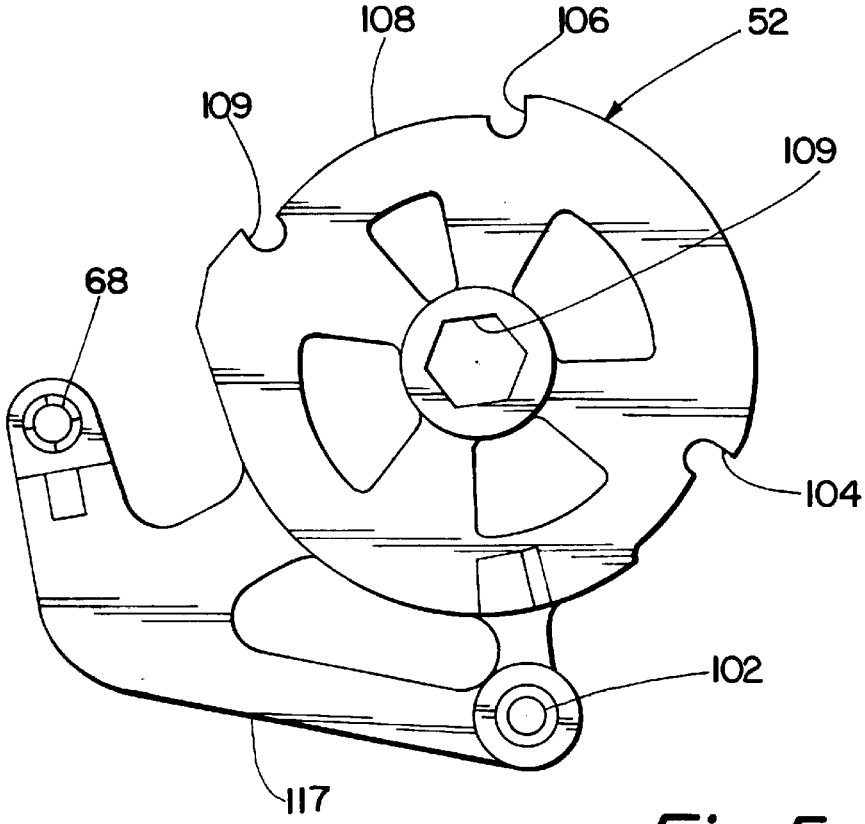
FIG. 5 is an elevational view of an output lever of the operating mechanism of FIGS. 1–3.
Figure 9:
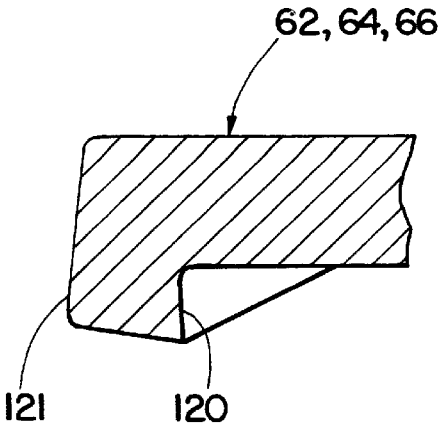
FIG. 9 is a partial sectional view on an enlarged scale taken along the line 9—9 of FIG. 7.
Figure 7:
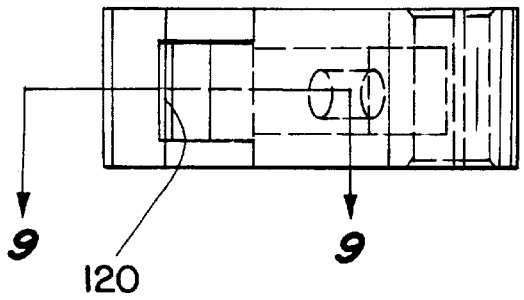
FIGS. 6–8 are respective front elevational, bottom plan, and left-side elevational views of a latch member of the operating mechanism of FIGS. 1–3.
Figure 8:
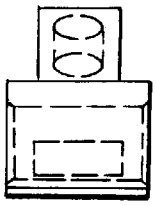
Figure 6:
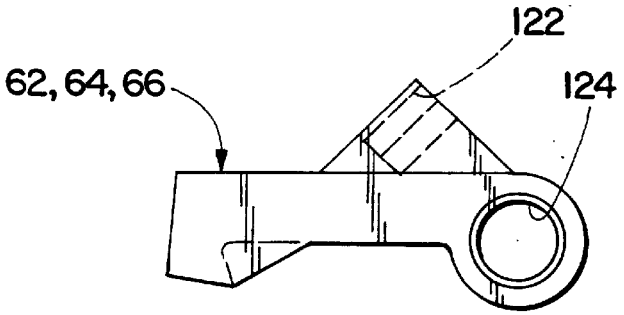

Referring now additionally to FIG. 5, the output lever 52 includes a drive pin 102 pivotally affixed to the output rod 98, e.g. the pin 102 extending through an aperture 111 of the output rod 98. As best seen in FIG. 5, the output lever 52 has a generally circular periphery 108 and includes a central aperture 109 for receiving the output shaft 43. The pins 68 and 102 are provided on a radially extending portion 117 of the output lever 52. Circumferentially arranged at predetermined locations along the periphery 108 of the output lever 52 are three shoulders 104, 106 and 107 which function as latch impact stops and also function separately as anti-reverse motion holding stops. The three shoulders 104, 106 and 107 divide the output lever 52 into areas of higher and lower radii.

Figure 2:
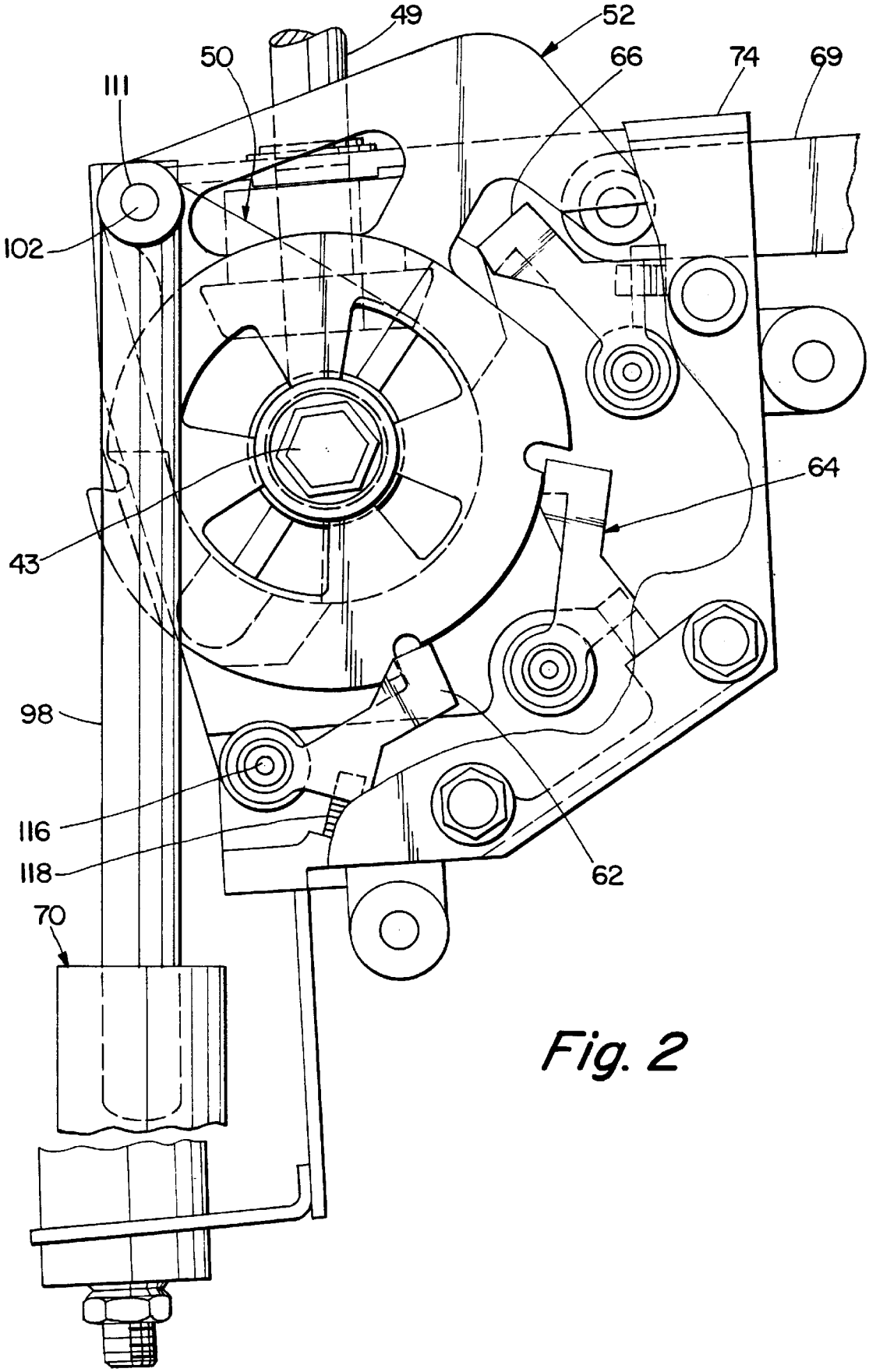
FIG. 2 is a front elevational view of the operating mechanism of FIG. 1 with parts cut away and removed for clarity.

The latch arms 62, 64 and 66 are pivotally mounted with respect to the housing 72 and are biased radially inward toward the output lever 52 by springs, e.g. as shown in FIG. 2, latch member 62 is pivotally mounted at 116 and biased by a spring 118. Referring now additionally to FIGS. 6–9, the latch members 62, 64 and 66 include latch surfaces 120 and 121, each of the latch surfaces 120, 121 being utilized for different directions of relative movement of the output lever 52 with respect to the latch members 62, 64 and 66. Further, the latch members 62, 64 and 66 include passages 122 for receiving the biasing springs, e.g. 118, and apertures 124 for the pivotal mounting at 116. During operation, when the drive lever 50 is pivoted counterclockwise in FIGS. 1 and 2 via the charging/driving input at 49 (i.e. from the ground position to the open position), the arm 81 of the drive lever 50 drives the charging link 94 to charge the spring arrangement 70 while the output lever 52 is held by the latch member 62 in the ground position. When the drive lever 50 is pivoted far enough such that the cam surface 85 lifts the latch member 62, the output lever 52 is released to pivot counterclockwise in response to the release of stored energy in the compressed spring 96 of the arrangement 70. When driven into the open position, the output lever 50 impacts on and is stopped from further pivoting by means of the latch member 64 acting against the shoulder 106 of the output lever 52.

In the open position, when the drive lever 50 is again pivoted counterclockwise, the cam surface 85 of the drive lever 50 lifts the latch member 64 and the output lever 52 is driven into the closed position whereat the latch member 66 impacts on and the output lever 52 is stopped by means of the shoulder 106 of the output lever 52.

Figure 12:
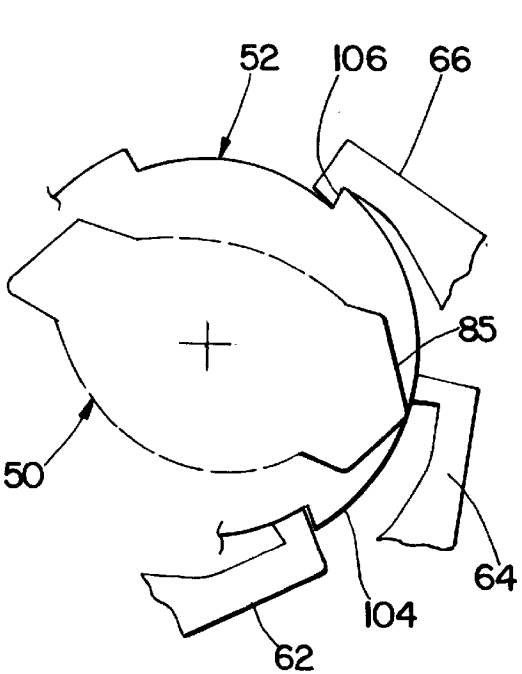
FIGS. 10–12 are diagrammatic representations of the drive lever, output lever, and latch members of the operating mechanism of FIGS. 1–9 illustrating three respective operating positions.
Figure 11:
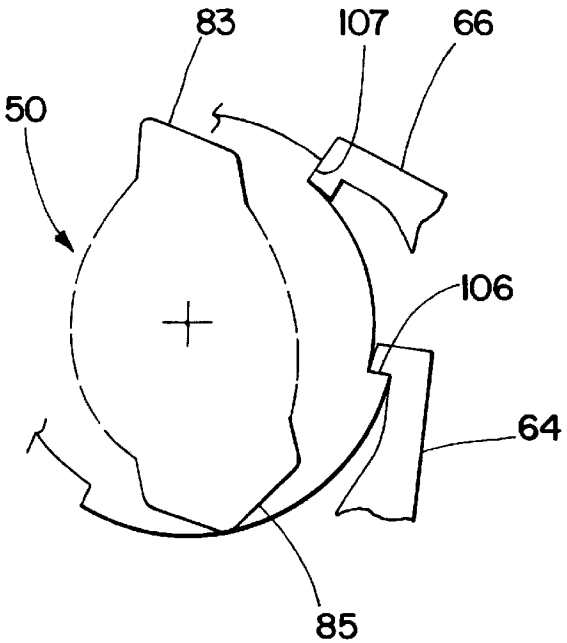
Figure 10:
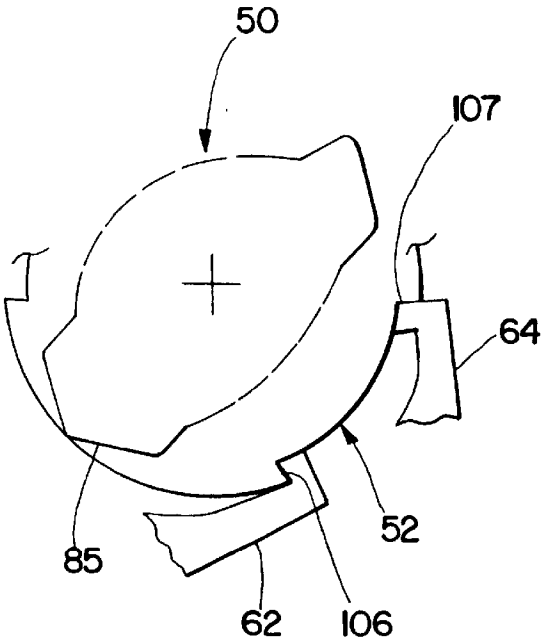

Referring now additionally to FIGS. 10–12, the positions of the drive lever 50, the output lever 52 and the latch members 62, 64 and 66 are illustrated for the respective operating positions, i.e. the ground position in FIG. 10, the open position in FIG. 11, and the closed position in FIG. 12. In accordance with important aspects of the present invention, the latch members 62, 64 and 66 in combination with the shoulders 107 and 104 also provide holding against anti-reversing in the ground, open and closed operational positions of FIGS. 10–12. For example, in the ground position of FIG. 10, the latch member 64 holds against the shoulder 107 of the output lever 52 which holds the output lever 52 against clockwise movement. Similarly, in the open position of FIG. 11, the latch member 66 holds against the shoulder 107 to prevent reverse (clockwise) movement. In the closed position of FIG. 12, the latch member 62 holds against the shoulder 104 to prevent reverse movement.

Considering now operation of the drive lever 50 in the clockwise direction in FIGS. 1 and 2, i.e. driving the output lever 52 from the closed position of FIG. 12 to the open position of FIG. 11, as the drive lever 50 moves clockwise and the spring arrangement 70 is charged, note that the holding latch member is now latch member 62 which prevents clockwise movement of the output lever 52 and the latch member 66 is the anti-reverse movement preventing latch member. When the drive lever 50 moves clockwise sufficiently such that the cam surface 86 of the drive member 50 lifts the latch member 62, the output lever 52 pivots clockwise until the latch member 66 impacts against the shoulder 107. In the open position of FIG. 12, with clockwise rotation of the drive member 50 to move the operating mechanism 40 into the ground position, the drive lever 50 via cam surface 83 lifts the latch member 66 whereupon the output lever 52 moves clockwise until the latch member 64 impacts against the shoulder 107.

Accordingly, from the foregoing discussion, it can be seen that the operating mechanism 40 in the open position of FIG. 11 can be operated to either the closed position of FIG. 12 or the ground position of FIG. 10 dependent upon the direction of rotation of the charging/driving input 49 and thus the drive lever 50.

Figure 13:
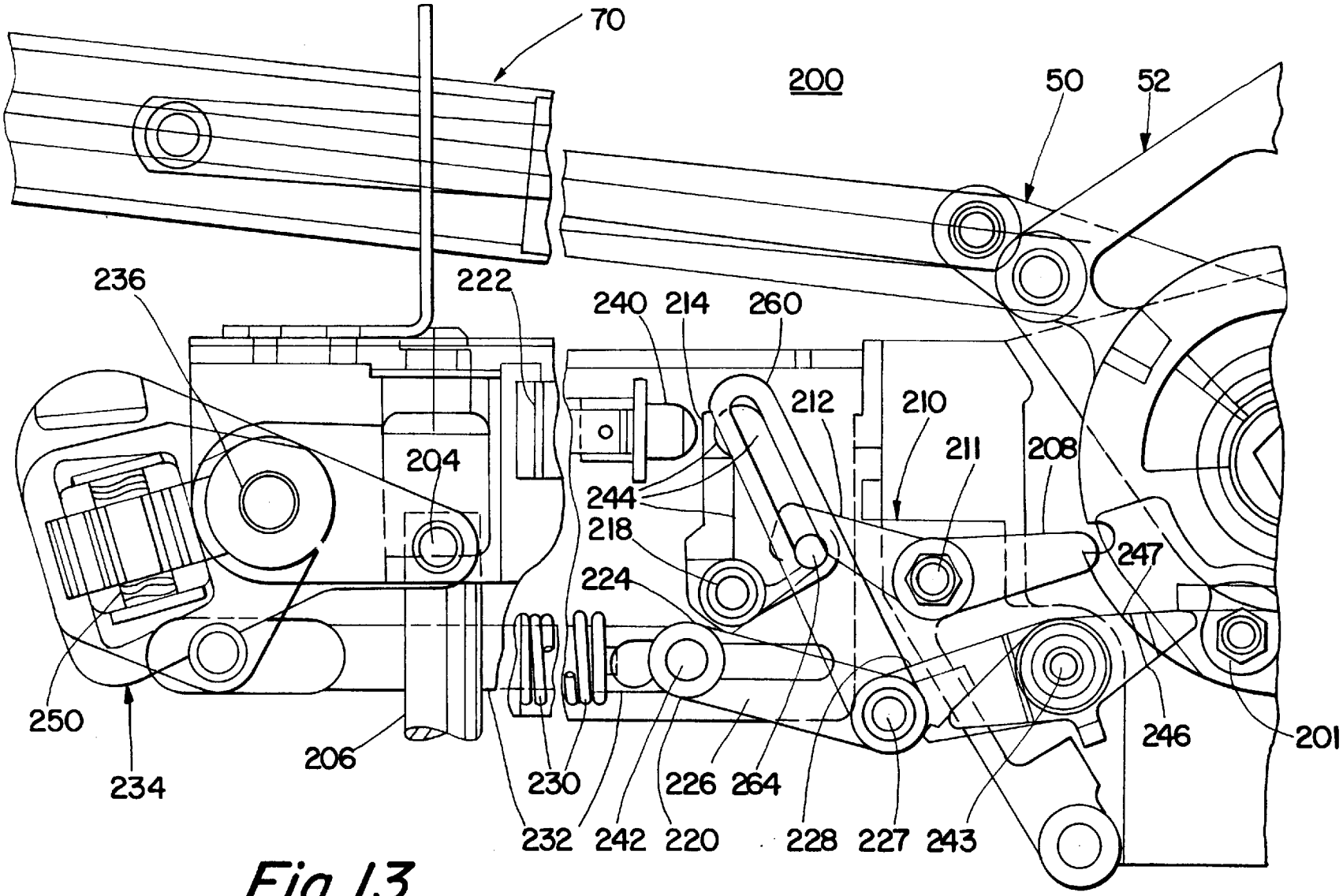
FIG. 13 is an elevational view of another embodiment of the operating mechanism of FIGS. 1–12 with additional features to operate a fault interrupter.
Figure 14:
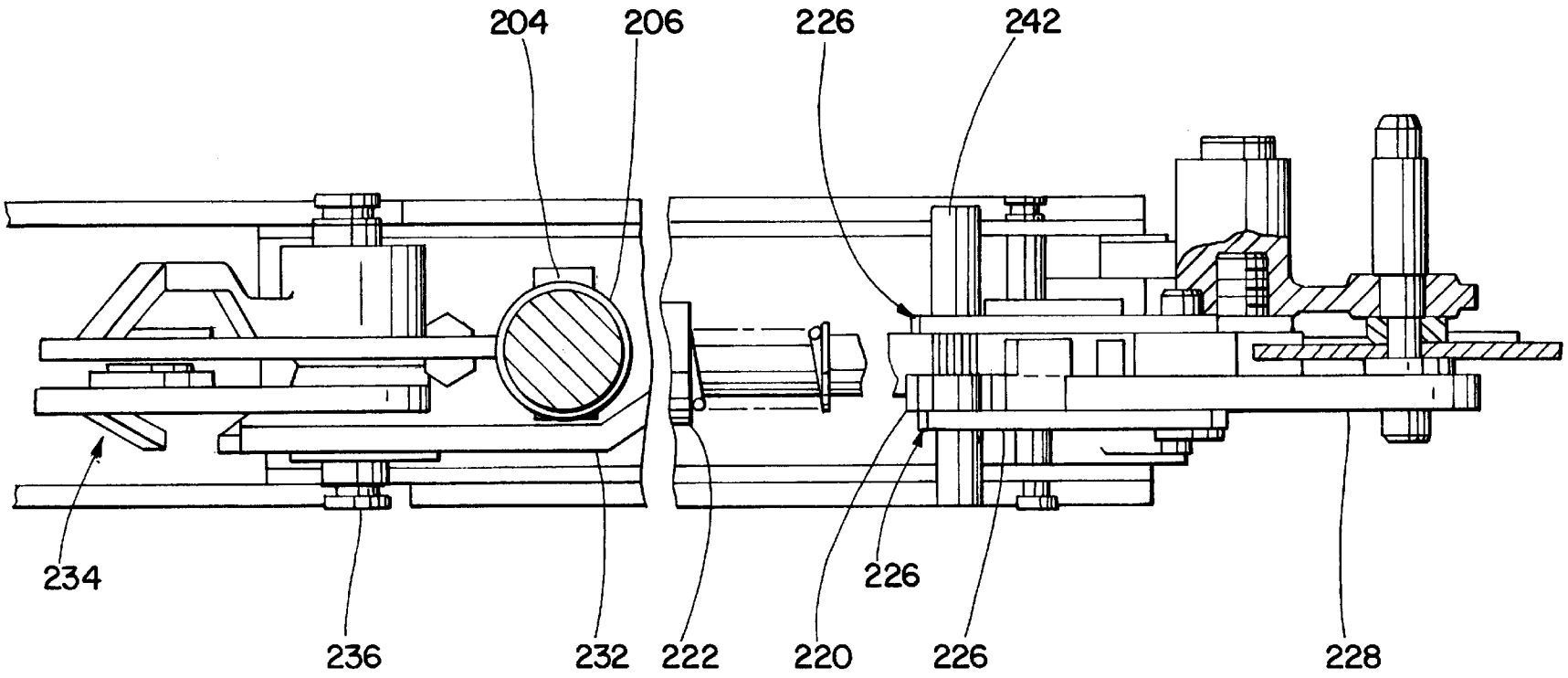
FIG. 14 is a bottom plan view of FIG. 13.

Referring additionally now to FIGS. 13–14 and considering the mechanism 200 to control the multiple positions of a disconnect switch at outputs 43 and/or 68 and the operation of a series-connected fault interrupter, the mechanism 200 is of the general type shown in U.S. U.S. Pat. No. 5,504,293. The mechanism includes the mechanism 40 and additionally includes features to sequence the operation of the a fault interrupter, for example the fault interrupter shown in U.S. Pat. Nos. 5,504,293 and 5,521,567 and copending application Ser. No. 08/705,460 filed in the names of T. G. French et al. on Aug. 29, 1996. Additionally, the drive lever 50 includes a trip pin 201, also see FIG. 4 at location 203. The output 204 of the mechanism 200 drives a rod 206 of the fault interrupter. The sequencing of operation of the mechanism 200 during opening is arranged such that the fault interrupter is opened first via output 204 and then the disconnect(s) are opened via the outputs 43 and/or 68. For closing operations, the fault interrupter is closed first via the output 204 and then the disconnect(s) are closed via the outputs 43 and/or 68. The fault interrupter output 204 can also be actuated via a solenoid 222 in response to fault detection via a trip signal that actuates the solenoid 222.

Considering first, an opening operation of the mechanism 200 from the closed position shown in FIGS. 13–14, as the drive lever 50 pivots approximately 30 degrees clockwise from the closed position toward the open position, the trip pin 201 extending from the drive lever 50 is arranged to contact an extending arm 247 of an actuating/recharge link 246 and pivot the actuating/recharge link 246 counterclockwise about its pivot point at 243. The arm 247 as it pivots contacts an extending arm 208 of a trip lever 210 and pivots the trip lever 210 counterclockwise about its pivot point at 211. An arm 212 of the trip lever 210 that extends on the opposite side of the pivot point 211 contacts a latch member 214 at extending portion 216 and pivots the latch member 214 clockwise about its pivot point at 218 sufficiently such that it clears a roller sleeve 220 at 224, allowing the toggle formed by two links 226 and 228 about a pivot point 227 to collapse. This collapse driven by a spring 230 (FIG. 13) drives a link member 232 to rotate a bellcrank assembly 234 counterclockwise about its pivot at 236. Rotation of the bellcrank assembly 234 drives the output at 204 and the rod 206, opening the connected fault interrupter linkage. As the drive lever 50 continues in its rotation, the outputs at 43 and/or 68 open the disconnect(s).

Considering an opening operation responsive to the detection of a fault, the solenoid 222 is operated so as to rapidly move a plunger 240 of the solenoid 222 to the right in FIG. 13 which drives the latch member 214 and as discussed before opening operation ensues as with operation via the drive lever 50. Resetting of the solenoid 222 occurs during the opening operation via movement of a resetting link 260. The resetting link 260 includes a slot 262 in which a pin 264 is disposed. The pin 264 extends from a relatch link 244 which is pivotally mounted about the pivot point 218. As the resetting link 260 moves generally upward in FIG. 13, the pin 264 is driven and rotates the relatch link 244 counterclockwise to close the solenoid 222 via the solenoid plunger 240.

Turning now to a discussion of closing of the fault interrupter via the output at 204 and the rod 206, when the drive lever 50 is rotated counterclockwise out of the open position and toward the closed position, the trip pin 201 contacts the actuating/recharge link 246 rotating it clockwise driving the two links 226 and 228 to a position that is almost a toggle position. This also drives the bellcrank assembly 234 via the link member 232 and a latch roller pin 242. The bellcrank assembly 234 is moved to a closed position at the output 204 via the rod 206. The latch member 214 is biased in the clockwise direction and moves into a position to block the roller sleeve 220 at 224. As the drive lever 50 continues rotation into the closed position, the outputs at 43 and/or 68 close the disconnect(s).

Figure 15:
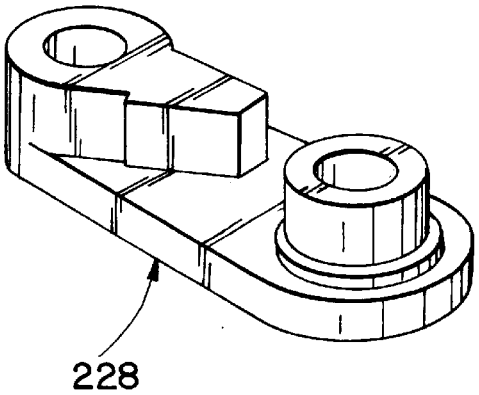
FIGS. 15 and 16 are respective views of a toggle link and recharge link of the mechanism of FIGS. 13 and 14.
Figure 16:
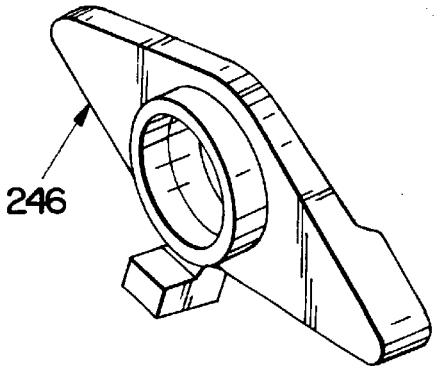

The bellcrank assembly 234 includes a spring 250 which provides compensation for contact erosion of the fault interrupter without any appreciable loss in contact pressure and also provides a quick response to the linkage system during opening operation. The toggle link 228 and the actuating/recharge link 246 are shown in more detail in FIGS. 15 and 16 respectively.

While there have been illustrated and described various embodiments of the present invention, it will be apparent that various changes and modifications will occur to those skilled in the art. For example is should be realized that the operating mechanism of the present invention can be utilized to control the sequenced operation of a variety of components. Accordingly, it is intended in the appended claims to cover all such changes and modifications that fall within the true spirit and scope of the present invention.

What is claimed and desired to be secured by Letters Patent of the United States is:

1. Apparatus comprising:

spring means for storing operating energy;

drive means responsive to a drive input for charging said spring;

output member means movably mounted and arranged to be driven by said spring means; and first means for stopping, latching and selectively releasing said output member means and defining at least three predetermined operating positions for said output member means, said first means comprising three movable latch members that are biased in a predetermined manner with respect to said output member and stop means on said output member means for defining with said three movable latch members said at least three predetermined operating positions, said first means further comprising means for selectively releasing said latch members at predetermined positions of said drive means whereby said output member is released for movement upon each of said three movable latch members being selectively released.

2. The apparatus of claim 1 wherein each of said three movable latch members include at least two latch surfaces.

3. The apparatus of claim 2 wherein said plurality of predetermined operating positions are defined by the number and placement of said three movable latch members with respect to said output member means.

4. The apparatus of claim 3 wherein said output member means comprises an output lever that is pivotally mounted in said apparatus.

5. The apparatus of claim 1 wherein said output member means comprises an output lever having a surface perimeter that includes abrupt changes at predetermined positions that define said stop means and cooperate with said three movable latch members.

6. The apparatus of claim 1 wherein said output member means includes a generally curved peripheral portion with defined shoulders.

7. The apparatus of claim 1 wherein two of said three movable latch members are operative in each of said at least three predetermined operating positions.

8. The apparatus of claim 7 wherein said two of said three movable latch members are operative to provide holding functions for said output member means that are each in a different direction of movement of said output member means.

9. The apparatus of claim 1 wherein said output member means comprises an output member and an operating shaft carried centrally of said output member, said output member further comprising a radially extending lever portion.

10. The apparatus of claim 1 wherein said drive means comprises a drive member having a periphery defining a plurality of cam surfaces which are arranged to selectively release said three movable latch members at predetermined respective positions of said drive member.

11. The apparatus of claim 1 further comprising second output means including a second output member and being responsive to said drive means for moving said second output member between first and second predetermined positions prior to said first output member being moved.

12. A switch operating mechanism comprising:

means for charging a spring;

first means including a first output member and being coupled to said spring for selectively releasing said spring and for moving said first output member into defined multiple output positions, said first means further comprising movable latch members and means for selectively releasing said movable latch members at predetermined positions of said charging means, said first output member being released for movement upon each of said movable latch members being selectively released; and second output means including a second output member and being responsive to said charging means for moving said second output member between first and second predetermined positions prior to said first output member being moved.

13. The switch operating mechanism of claim 12 further comprising means for operating said second output member independently of said first means and without movement of said first output member.

* * * * *